US005973240A

United States Patent [19]

Isaka

[11] Patent Number: 5,973,240

[45] Date of Patent: Oct. 26, 1999

[54] MUSIC BOX

[75] Inventor: Ahihiko Isaka, Nagano, Japan

[73] Assignee: Sankyo Seiki Mfg. Co., Ltd., Nagano-ken, Japan

[21] Appl. No.: 09/136,344

[22] Filed: Aug. 19, 1998

[30] Foreign Application Priority Data

Aug. 20, 1997 [JP] Japan ..... 9-238896

[51] Int. Cl.[6] ..... G10F 1/06

[52] U.S. Cl. ..... 84/97; 84/98

[58] Field of Search ..... 84/94.1, 94.2, 84/95.1, 95.2, 96–101

[56] References Cited

FOREIGN PATENT DOCUMENTS 5-66694 3/1993 Japan .

*Primary Examiner*—Stanley J. Witkowski

*Attorney, Agent, or Firm*—McAulay Nissen Goldberg Kiel & Hand, LLP

[57] ABSTRACT

A music box comprises a base disc which has a plurality of projections corresponding to a music piece on its surface, a plurality of pin wheels which are individually rotated by contacting one of a plurality of such projections while the disc moves, a reed which generates sound by being picked by a pin portion projecting in the radial direction of the pin wheels, a plurality of dampers which are formed corresponding to each of the pin wheels to reduce vibration of the reed and a fixed shaft which rotatably supports individual pairs of the pin wheels and the corresponding dampers. The dampers further comprises a base portion which has combining device to rotate together with the corresponding pin wheels, an arm portion which is extended from the base portion to the vicinity of the pin portion and a contacting portion which is the end of the arm portion placed near the pin portion and which comprises a rotation path common with the pin portion such that the contacting portion contacts the reed for reducing vibration before the pin portion contacts the reed.

5 Claims, 8 Drawing Sheets

MUSIC BOX

BACKGROUND OF THE INVENTION a) Field of the Invention

The present invention relates to a music box using pin wheels, and more specifically, to an anti-vibration damper which stops the vibration remaining in a reed immediately prior to its being picked.

b) Description of the Related Art

FIG. 7(*a*) shows essential sections of a disc music box as a representative model of music boxes using pin wheels. In disc music box 100, thin disc 102, on which projections 101 are cut out downward by a press process, is rotationally driven by a driving source (not shown in the figure) in the direction indicated by arrow R. Projections 101 are arranged on disc 102 to correspond to a music piece played by the music box. Also, projections 101 may be formed in forms shown in FIGS. 7 (*b*) and (*c*). In the body of the music box having disc 102, pin wheel unit 105, in which a plurality of pin wheels 104 are individually rotatable around fixed shaft 103 extended in the radial direction, and two combs 108*a* and 108*b* are placed. When disc 102 rotates in the direction indicated by arrow R, projections 101 engage pin portion 106 of pin wheel 104 placed within a moving path in which projections 101 moves such that pin wheels 104 are rotated in the direction indicated by arrow L by a predetermined angle. Thereafter, other pin portion 106, which is not engaged to projections 101, picks the reeds of combs 108*a* and 108*b* to generate sound.

FIG. 8 shows a body of a disc music box having a conventional structure; the following explains the disc music box for more detail using the figure. First comb 108*a* and second comb 108*b*, which comprise reeds 107*a*, 107*b*, respectively, having the same number as pin wheels 104, are placed in a predetermined position according to a musical scale on either side of pin wheel unit 105. More specifically, first and second combs 108*a* and 108*b* are fixed to base mount 109 wherein reeds 107*a*, 107*b* are arranged such that their ends can be disengaged from pin portions 106 of pin wheels 104.

Also, guide rollers 110 are placed at appropriate distance from each other around fixed shaft 103 of pin wheel unit 105 to support the bottom surface of disc 102. Guide rollers 110 sandwich disc 102 with pressing rollers 112 which are supported by disc pressing frame 111 above disc 102 and which are placed across from guide rollers 110. As a result, disc 102 is warped by a force acting thereat when projections 101 are engaged to pin portions 106 such that incomplete engagement is prevented.

Dampers 113*a*, 113*b* are formed on one side of each of pin wheels 104 in parallel to each other corresponding to reeds 107*a*, 107*b*, respectively, on either side; they are also fixed to base mount 109 via damper alignment rails 117*a*, 117*b*. Dampers 113*a*, 113*b* touch pin wheels 104 such that inertial movement is suppressed. Also, the dampers comprise stopper 114, which maintains the positional relationship of pin portion 106 to reeds 107*a*, 107*b*, and anti-vibration pieces 115*a*, 115*b* which stops vibration remaining in reeds 107*a*, 107*b* by contacting the sides of reeds 107*a*, 107*b* while the pin wheels are suspended.

Furthermore, convex portions, which interfere with the movement of pin portion 106, are formed on the surface of dampers 113*a*, 113*b* facing pin portions 106 by expanding the portions of 116*a*, 116*b* corresponding to the space between adjacent two pin portions 106 of pin wheels 104 during suspension of movement. The convex portions are pushed out of the moving path of pin wheels 104 by pin portion 106 when pin wheels 104 rotate. As a result, anti-vibration pieces 115*a*, 115*b* are displaced in continuous motion therein such that reeds 107*a*, 107*b* are released for free vibration.

This disc music box functions as follows. When disc 102 rotates, one of projections 101 is engaged to pin portion 106 in the moving path such that pin wheels 104 are turned. Then, immediately prior to picking of reeds 107*a*, 107*b* facing one of the two pin portions adjacent to the convex portions of dampers 113*a*, 113*b*, namely 106, which rotates ahead of another pin portion following pin portion 106, pushes the facing convex portions of dampers 113*a*, 113*b* such that reeds 107*a*, 107*b* are released from anti-vibration pieces 115*a*, 115*b*. Consequently, reeds 107*a*, 107*b* are picked by leading pin portion 106 such that reeds 107*a*, 107*b* freely vibrate to generate sound.

Pin wheels 104 stop rotation when their engagement is released by passing projections 101. Then, the convex portions of dampers 113*a*, 113*b* fall between following two pin portions 106 again such that vibration of reeds 107*a*, 107*b* is suppressed by anti-vibration pieces 115*a*, 115*b* which contact thereat. If vibration remains therein, the reeds contact the following pin portions to cause noise. In other words, dampers 113*a*, 113*b* are formed for the purpose of eliminating such noise due to the vibration remaining in reeds 113*a*, 113*b*.

Also, a damper may be fixed to a reed as shown in FIG. 9. In cylindrical music box 200, damper 202 made of a wire or a film is adhered underneath reed 201 which is firmly fixed to base mount 205. While cylinder 203 moves in the direction indicated by arrow C such that pin 204 shifts from pin position 204*a* to pin position 204*c*, the following operation takes place. At pin position 204*b*, which is a position immediately prior to picking of reed 201 by pin 204, the end of damper 202 is pushed up such that distortion caused in the wire or film of damper 202 lessens vibration; furthermore, the end of damper 202 contacts reed 201 such that vibration is stopped. Thereafter, pin 204 picks reed 201 and shifts to pin position 204*c*. As described above, damper 202 lessens/stops vibration of reed 201 immediately prior being picked by pin 204 such that noise including broken sound and the like is prevented.

Additionally, in disc music box 100, suppression of vibration remaining in reeds 107*a*, 107*b* is canceled immediately before the reeds are picked by pin portion 106, and vibration is stopped immediately after being picked such that reverberation is eliminated. On the other hand, in cylindrical music box 200, vibration is stopped immediately before pin 204 picks reed 201; reed 201 freely vibrates immediately after being picked such that reverberation exists.

In either of the above methods, dampers 103*a*, 103*b* or damper 202 are/is fixed. Therefore, pin wheels 104 or cylinder 203 contacts still dampers 103*a*, 103*b* or damper 202 during rotation such that braking force acts on pin wheels 104 or cylinder 203 due to friction resistance by contacting. As a result, large rotational torque is required for driving disc 102 or cylinder 203.

In disc music box 100, the shape of dampers 103*a*, 103*b* is complex and are fixed separate from reeds 107*a*, 107*b* and pin wheels 104; therefore, it is difficult to obtain precision in relative positions and sizes. Additionally, dampers 103*a*, 103*b* must be individually fixed while adjusting conditions of engagement of an individual damper corresponding to reeds 107*a,* 107*b* and pin portion 106; thus, more time is required for assembly, which is extremely inefficient.

Furthermore, for damper 202, as seen in cylindrical music box 200, sizes required for a length of the end part, the shape and a distance from reed 201 must be extremely precise. Also, it is difficult to obtain stability in preventing noise, in addition to difficulty in operation to fix damper 202 by adhesion. Moreover, when vibration energy is increased by thickening (or widening) reed 201 in order to improve acoustics, prevention of noise by stopping vibration of reed 201 may be incomplete unless the thickness of the film or diameter of the wire forming damper 202 is increased.

Moreover, when a thick film or a thick wire is used in damper 202, the film or wire of damper 202 moves away by being pushed by pin 204 such that noise tends to be generated due to elasticity of damper 202 thereafter. Also, a means in which damper 202 is fixed by directly adhering it to reed 201 may deteriorate sound qualities since a foreign object is adhered to the end of the damper due to the use of an adhesive.

OBJECT AND SUMMARY OF THE INVENTION

Therefore, the primary object of the present invention is to reduce a loss by friction to the pin portion by rotating a pair of the pin portion and the damper together and to eliminate effects of the damper to sound qualities by not fixing the damper to the reed. A further object is to minimize noise due to elasticity of the damper or noise by the pin wheels or cylinder by improving the arm portion of the damper.

In accordance with the invention, a music box comprises a base disc which has a plurality of projections corresponding to a music piece on its surface, a plurality of pin wheels which are individually rotated by contacting one of a plurality of such projections while the disc moves, a reed which generates sound by being picked by a pin portion projecting in the radial direction of the pin wheels, a plurality of dampers which are formed corresponding to each of the pin wheels to reduce vibration of the reed and a fixed shaft which rotatably supports individual pairs of the pin wheels and the corresponding dampers. The dampers further comprises a base portion which has combining means to rotate together with the corresponding pin wheels, an arm portion which is extended from the base portion to the vicinity of the pin portion and a contacting portion which is the end of the arm portion placed near the pin portion and which comprises a rotation path common with the pin portion such that the contacting portion contacts the reed for reducing vibration before the pin portion contacts the reed.

BRIEF DESCRIPTION OF THE DRAWINGS

In the drawings:

FIG. 1 (*a*) is an oblique view showing an enlarged part A;

DESCRIPTION OF THE PREFERRED EMBODIMENTS

Figure 1:
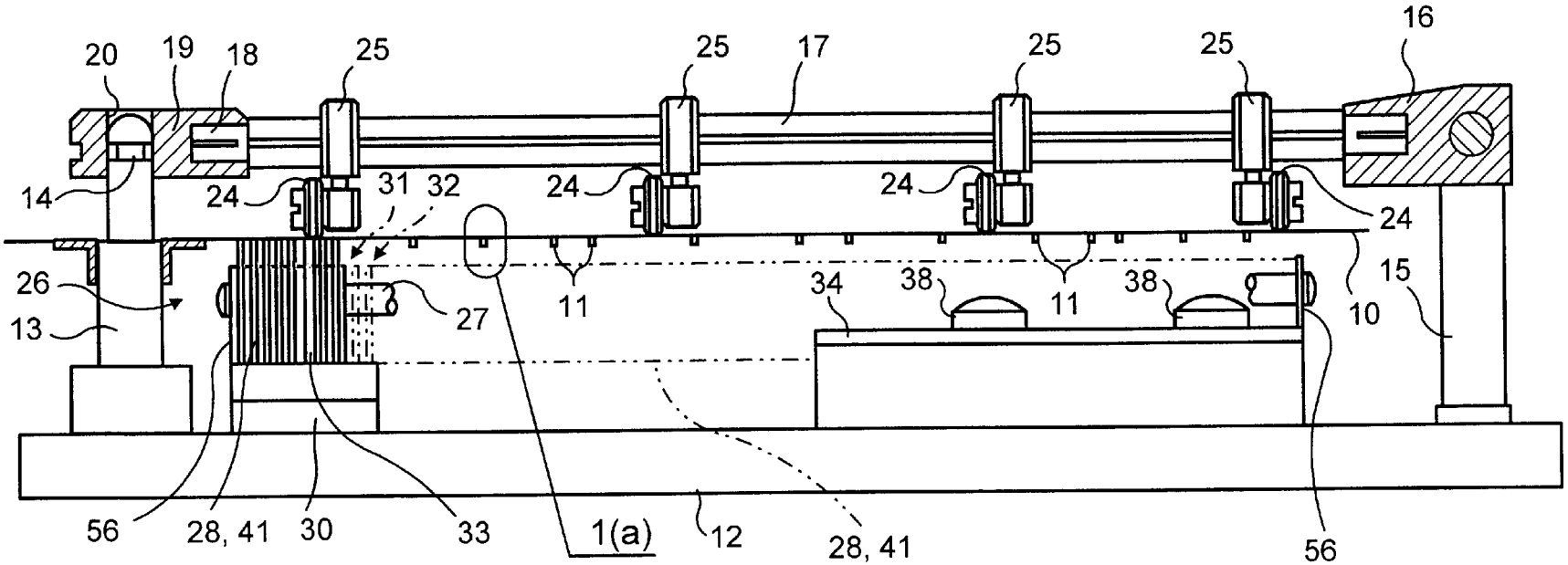
FIG. 1 is a partial side view showing an embodiment of a music box of the present invention.
Figure 1A:
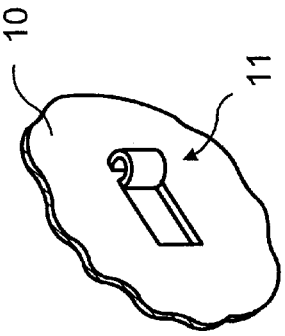
Figure 2:
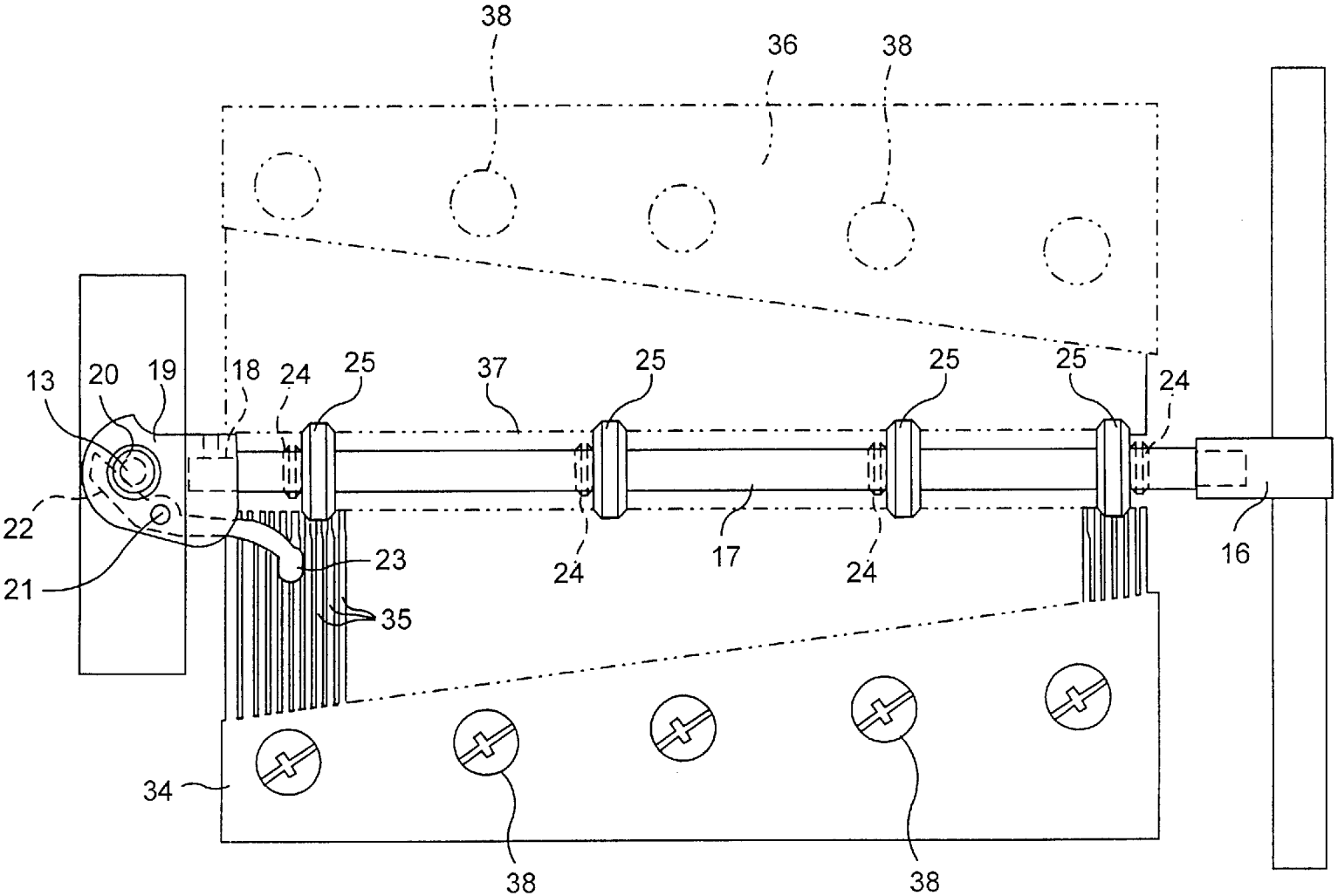
FIG. 2 is a partial plan view showing an embodiment of the music box of the present invention without a disc.

The following explains embodiments of a music box of the present invention in reference to FIGS. 1 through 6. FIGS. 1 through 6 show a disc music box, in which a base disc is in a form of a disc where an order of notes and a tempo of a music piece are recorded, as an example of a pin wheel music box. In FIGS. 1 and 2, relative positions of reeds and pin wheels, which picks the reeds, are explained. Disc 10 can be replaced according to selection of music pieces wherein its center hole is pieced such that disc 10 is rotatably supported around rotational center shaft 13 which stands on base mount 12. On the bottom surface of disc 10, a plurality of driving projections 11, made of a cut-out piece as shown in an enlarged oblique view of FIG. 1 (*a*), are formed according to a music pattern. Projections 11 are engaged to the pin portion as described later to drive it.

The outer circumference of disc 10 rotationally drives disc 10 within a plane together with a driving force of the driving portion mounted on and connected to a guide roller (not shown in the figure). Also, support 15 is formed at a position distant from the area of base mount 12 in which disc 10 is rotated. Hinge portion 16 formed on the top end of support 15 rotatably supports disc pressing frame 17 extending along almost the radius of disc 10. At end portion 18 of disc pressing frame 17, clamp 19 is fixed thereat on which see-through hole 20 is formed to fit around rotational center shaft 13.

Clamp 19 has clamp lever 22 which is moveably supported by shaft 21 and which can be disengaged from round groove 14 formed at rotational center shaft 13. Roller holders 25 are appropriately placed on disc pressing frame 17 at almost the same distance; each of roller holders 25 rotatably supports pressing roller 24. After rotational center shaft 13 is engaged on disc 10 penetrated in the center hole of disc 10 from its top end first, see-through hole 20 of clamp 19 is engaged to rotational center shaft 13 such that clamp lever 22 is engaged to round groove 14. As a result, disc pressing frame 17 is clamped such that pressing rollers 24 press disc 10 to obtain stable engagement between driving projections 11 and the pin portion, as described later.

In order to remove a pressing force of disc pressing frame 17 onto disc 10, one end 23 of clamp lever 22 is rotated counterclockwise such that clamp lever 22 is disengaged from round groove 14. As a result, disc pressing frame 17 can be lifted by rotating clockwise by hinge 16. Disc 10 can be changed by the above operation.

Pin wheel unit 26 of the music box of the present invention is placed at a lower position facing disc pressing frame 17 on the other side of disc 10. Pin wheel unit 26 comprises fixed shaft 27, which is placed parallel to disc pressing frame 17, and pin wheel holder 30 which is structured such that fixed shaft 27 is rotatably inserted into a plurality of pin wheels 28 a paired with dampers 41. Around fixed shaft 27, guide roller 33 is rotatably supported at a position across from pressing roller 24. Guide roller 33 supports disc 10 together with pressing roller 24 such that stable rotation of disc 10 is accomplished; also it maintains engagement between driving projections 11 projecting downward from the bottom surface of disc 10 and pin portions 29 projecting from pin wheels 28 constant.

First comb 34 and second comb 36 are placed facing each other on either side of pin wheel unit 26 and are fixed to base mount 12 by screws 38. The number of reeds 35 forming first comb 34 and of reeds 37 forming second comb 36 are the same as the number of pin wheels 28. Reeds 35, 37 are placed such that their ends can be appropriately engaged to corresponding pin portions 29 of pin wheels 28.

In pin wheel holder 30 of pin wheel unit 26 shown in FIG. 1, partitions 32 are placed at a given distance in parallel in order to separate adjacent pairs of pin wheel 28 and damper 41. The number of slits 31 which contain pairs of pin wheels 28 and dampers 41 is the same as the number of reeds held by one comb.

Figure 3:
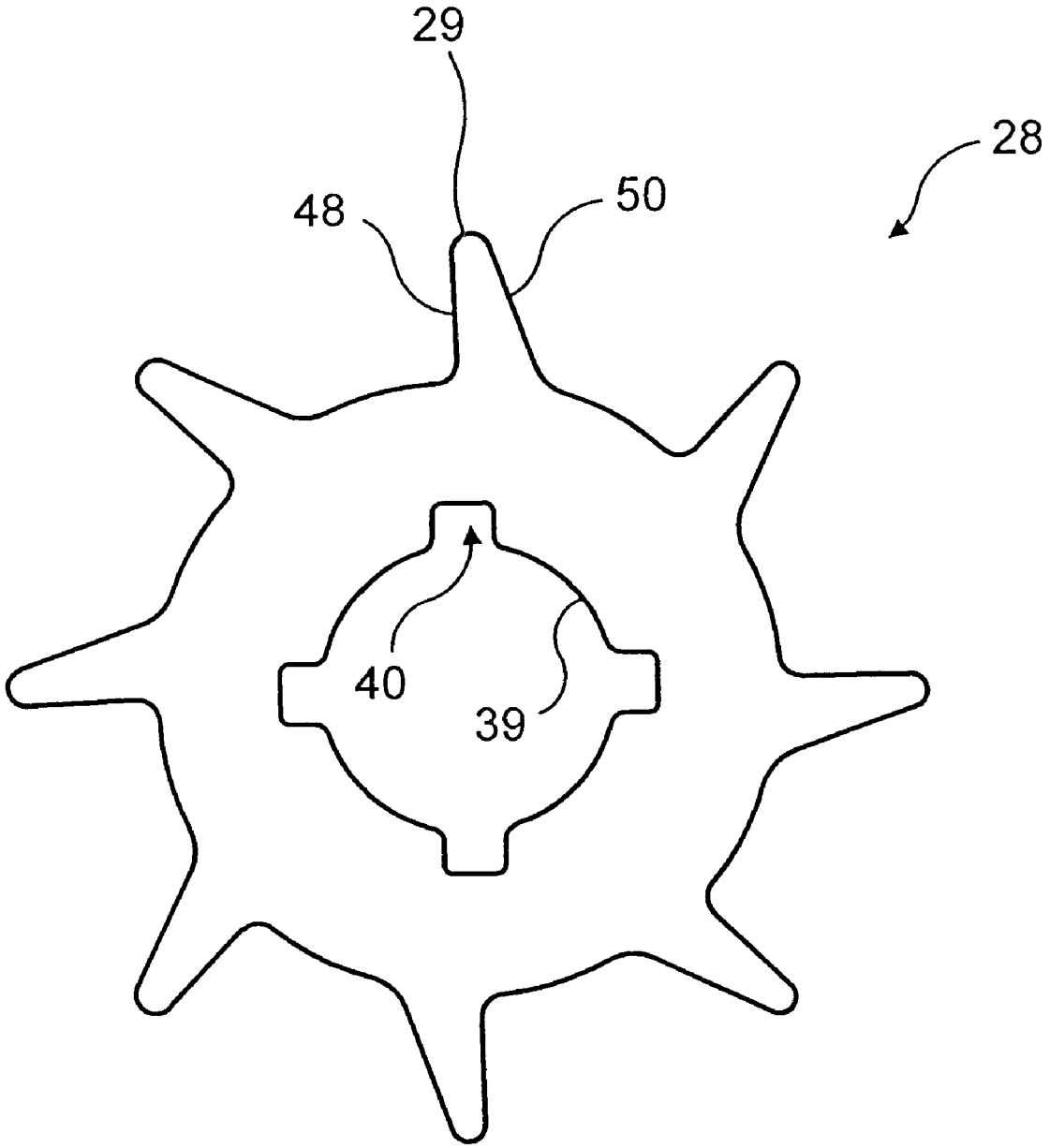
FIG. 3 is a plan view showing an embodiment of a pin wheel in a music box of the present invention.
Figure 4:
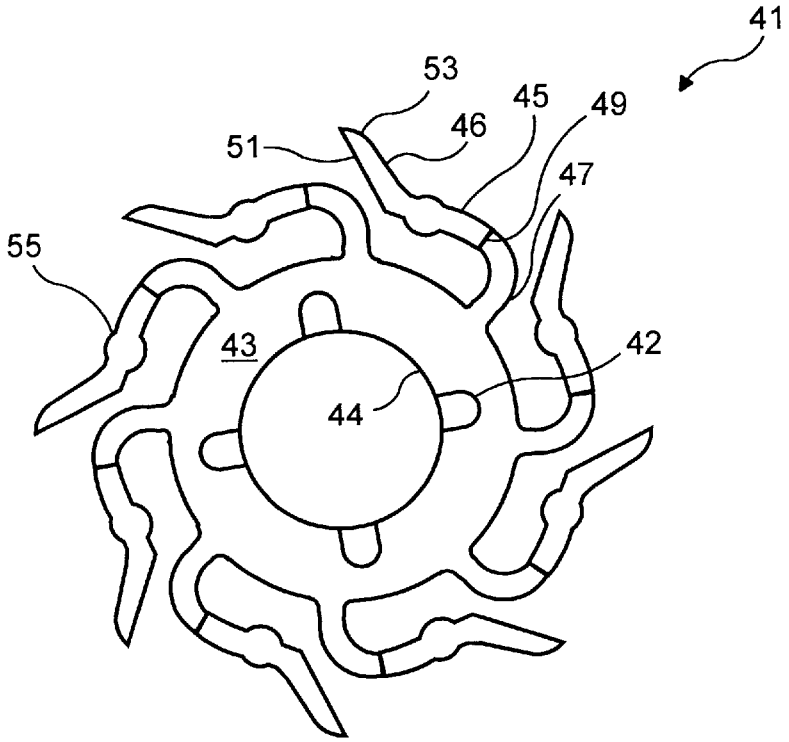
FIG. 4 is a plan view showing an embodiment of a damper in a music box of the present invention.

Pin wheel 28, as shown in FIG. 3, comprises a plurality of pin portions 29, which are formed at the same distance around the outer edge, and center hole 39, through which fixed shaft 39 rotatably penetrates, formed at the center. Several key grooves 40 (four in FIG. 3) are formed expanding radially from center hole 39 outward at the same distance and match key 42 of damper 41 as described later. Pin wheel 28 is a plate made of steel with thickness "t" and is heat treated by means such as quenching and tempering.

Damper 41 is a formed of engineering plastics having high abrasion resistance and appropriate viscoelasticity; the number of dampers 41 is the same as pin wheels 28. Each pin wheel 28 makes an individual pair with corresponding damper 41. As shown in a plan view of FIG. 4 and in a oblique view of FIG. 5, damper 41 comprises arm portions 45 which correspond to pin portions 29 and which are placed radially from annular base portions 43 closely contacting one side of pin wheel 28. Also, keys 42 project outward along center hole 44 of both sides of annular base portion 43, which closely contact pin wheels 28, to provide a connecting means for damper 41 to uniformly rotate with pin wheel 28.

Base portion 47 of arm portion 45 stands up outward from the periphery of annular base portion 43 maintaining the same thickness, then the arm curves at a relatively large curvature along the circumference of a concentric circle by about 90°. Then, step portion 49 having about the same thickness as thickness "t" of pin wheel 28 is formed along a position corresponding to the position of back surface of a pin portion 29, which is almost along the radius of pin wheel 28 connected on the side of damper 41 (see FIG. 5).

Figure 5:
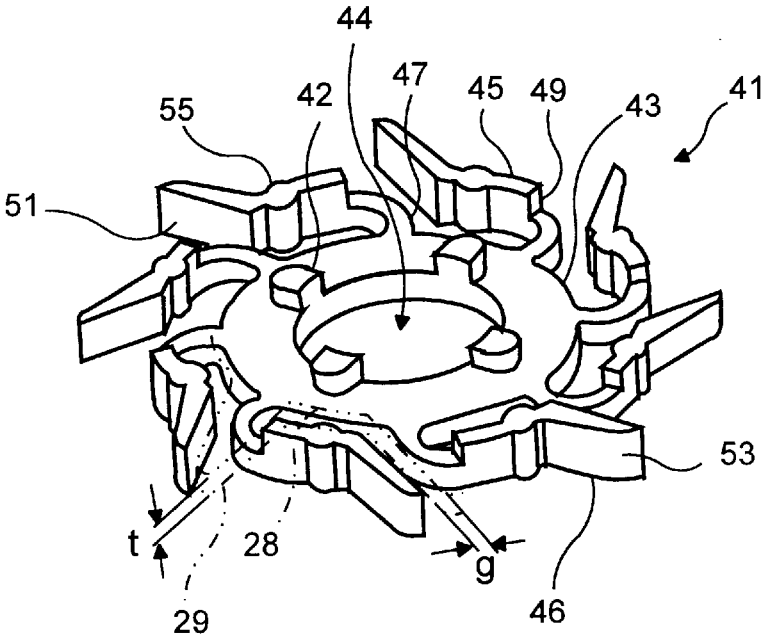
FIG. 5 is an oblique view of FIG. 4.

As shown in FIG. 5, a section between step portion 49 and the end has the thickness to form a plane continuing to the outside surface of pin portion 29 wherein contacting portion 46, which faces reeds 35, 37, is formed. Therefore, the end is free of any constraint due to contacting pin wheel 28. Expanding portion 55 at the middle of arm portion 45 is a gate mark caused during the forming process; hence, it may not be formed depending on the method of forming damper 41. Also, it has no effects on the function of damper 41.

Pin wheel 28 is combined with damper 41 wherein center hole 39 of pin wheel 28 and center hole 44 of damper 41 are matched to each other such that key 42 of damper 41 is engaged to key groove 40 of pin wheel 28. Since pin wheel 28 and damper 41 are industrially formed, the relative positional relationship of pin portion 29 and damper arm portion 45 is naturally determined by matching one pair, and no adjustment is required. In other words, back surface 51 of thicker contacting portion 46, of which the relative position is fixed by the above assembling of the two pieces together, faces tapered front surface 50 formed on the following pin portion in parallel at a given distance "g" (see FIG. 6).

After inserting the above pair in all of slits 31 of pin wheel holder 30, fixed shaft 27 is inserted through the through holes of brackets 56 formed on either side of pin wheel holder 30 and center holes 39, 44 of pin wheel 28 and damper 41 which are combined with each other. Fixed shaft 27 is fixed by being forced into the through holes of brackets 56 of pin wheel holder 30 such that fixed shaft 27 does not move in the axial direction.

Figure 6:
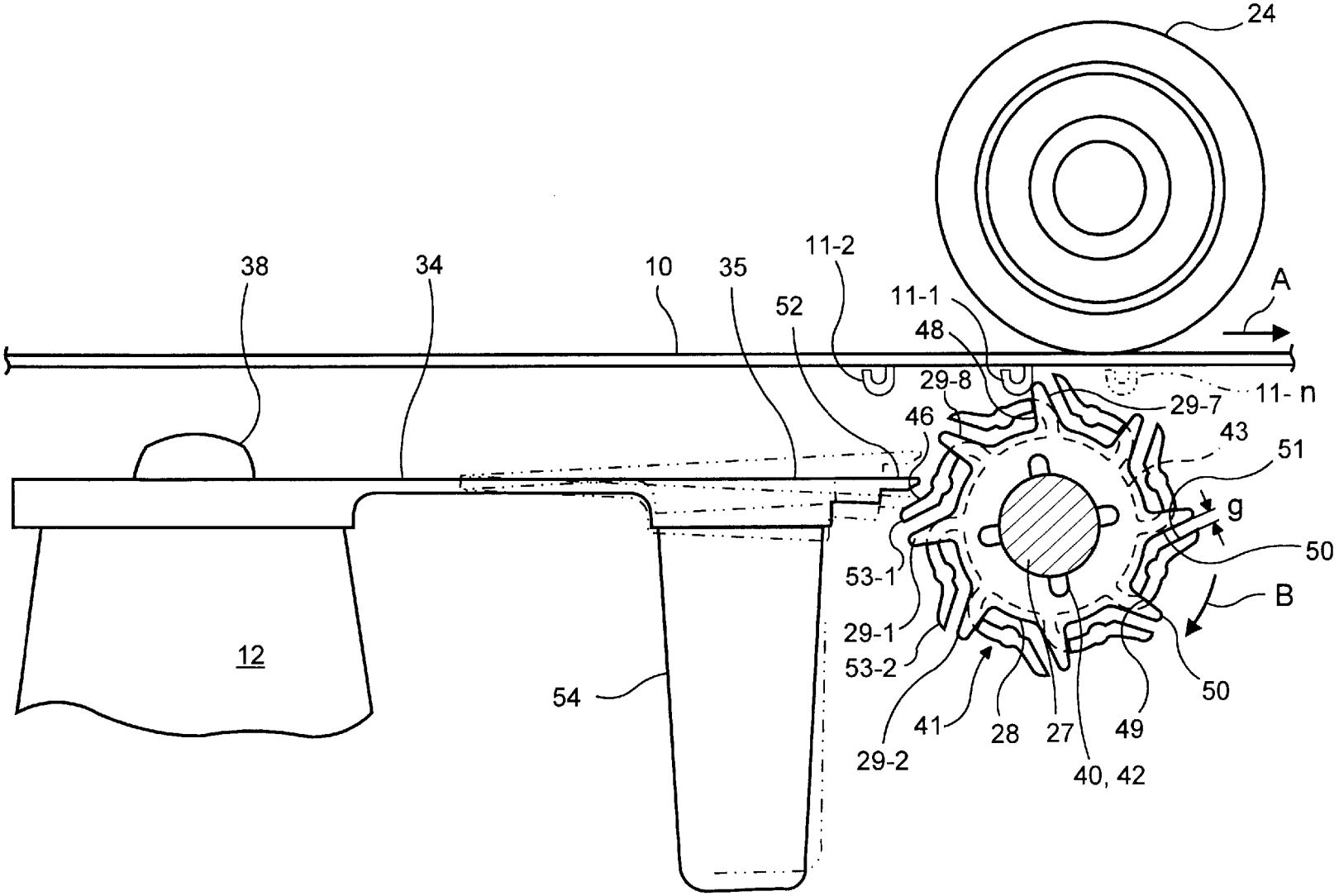
FIG. 6 is a schematic side view to explain functions of an embodiment of a music box of the present invention.
Figure 7A:
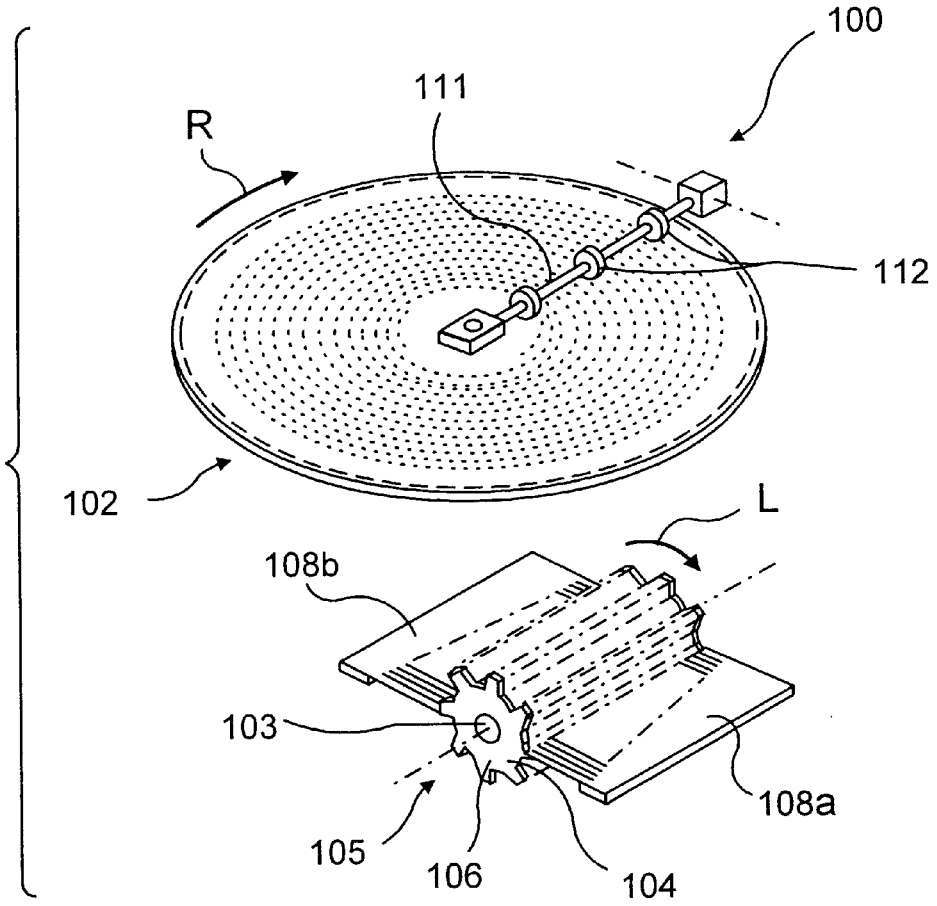
FIG. 7 (*a*) is an expanded oblique view to briefly explain an entire disc music box, FIG. 7 (*b*) is an oblique view showing an example of a projection on a disc, and FIG. 7(*c*) is an oblique view showing other example of a projection.
Figure 7B:
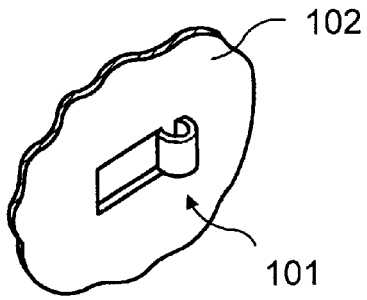
Figure 7C:
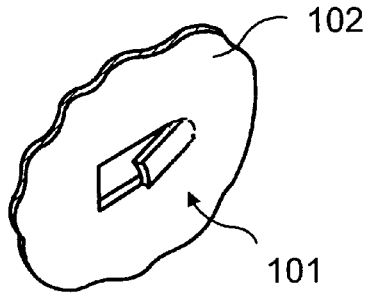
Figure 8:
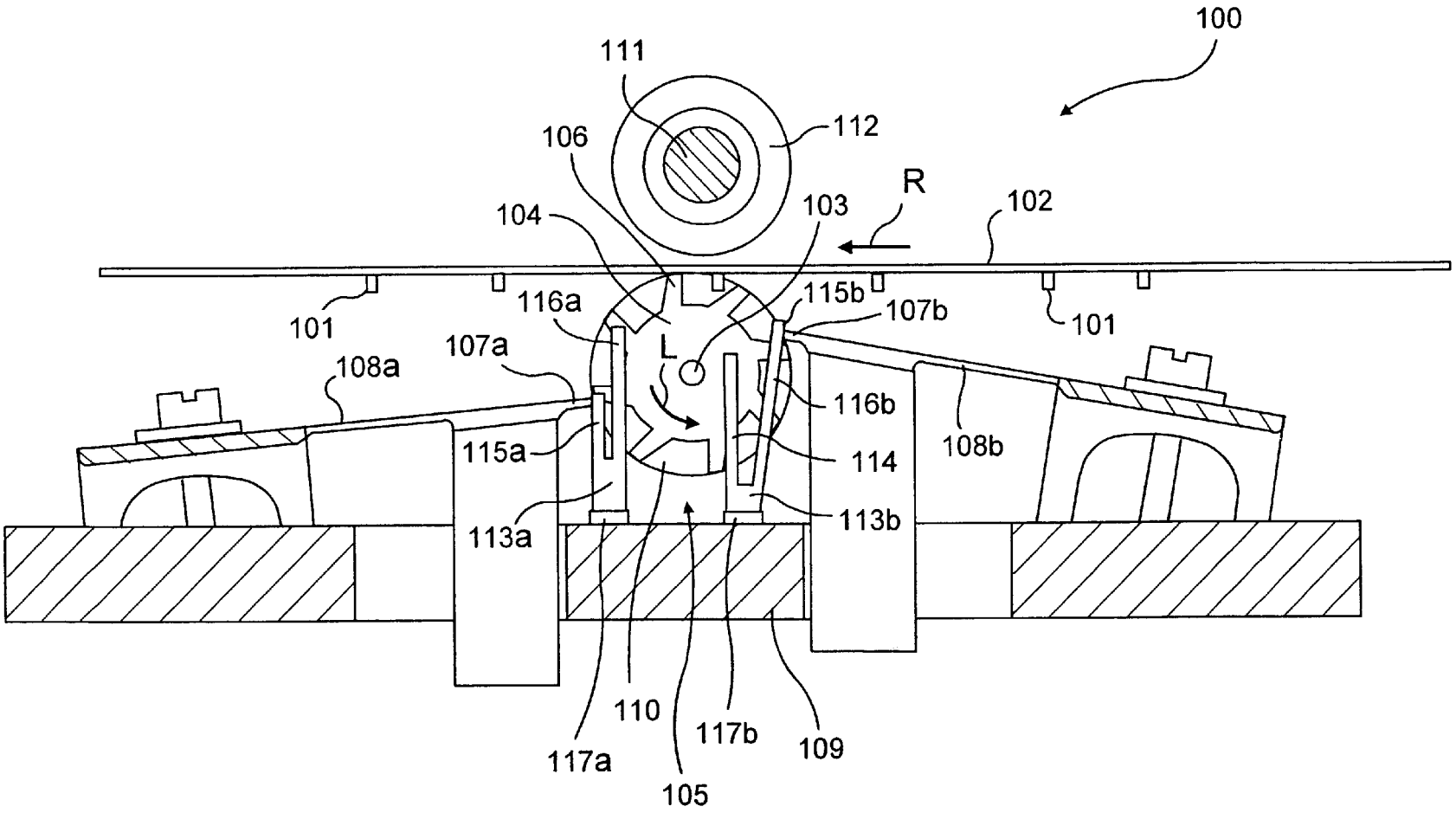
FIG. 8 PRIOR ART
FIG. 8 is a schematic side view showing damper parts in a conventional disc music box.
Figure 9:
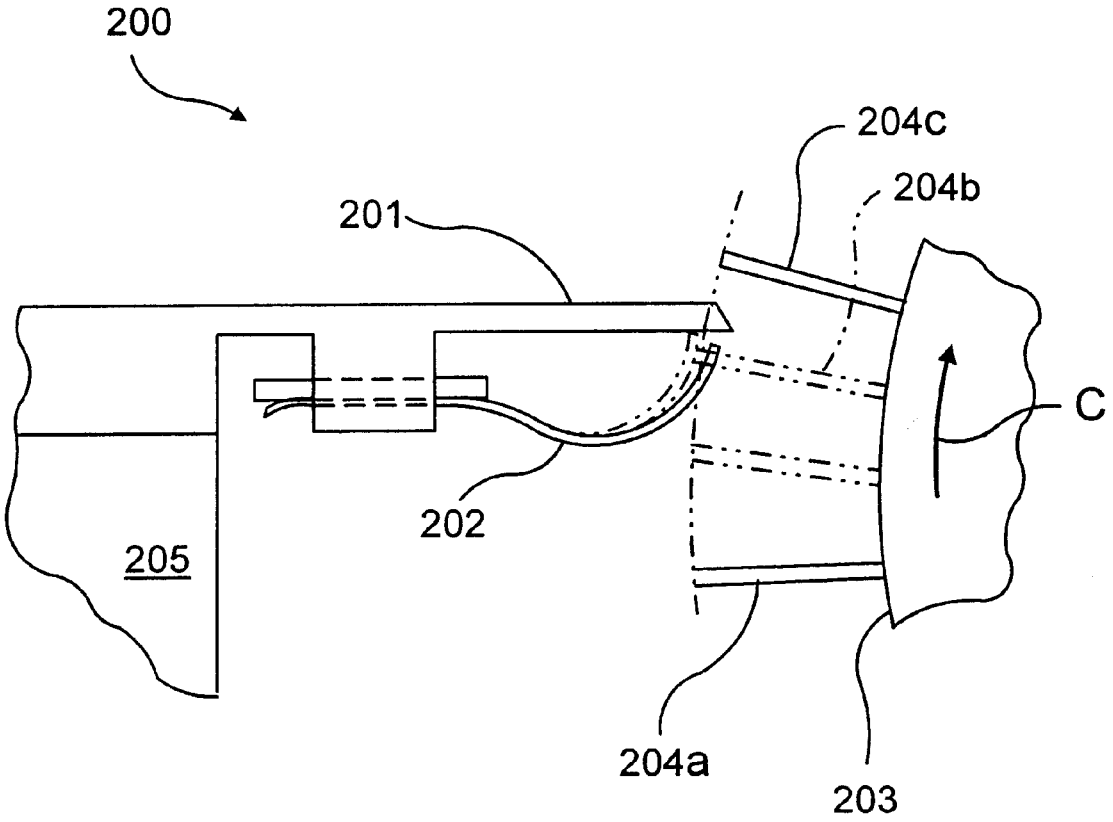
F I G. 9 PRIOR ART
FIG. 9 is a schematic side view showing damper parts in a conventional cylindrical music box.

The following describes operation of the music box of the present invention in reference with FIG. 6. Regarding relationships between pin wheel 28 and first comb 34 and second comb 36, mutual actions are the same in either relationship, except, directions in which reed 35 and reed 37 are picked by pin portions 29 are different. Therefore, only operation of first comb 34 is discussed hereafter, and any discussion regarding second comb 36 is omitted.

When disc 10 rotates in the direction indicated by arrow A, driving projection 11-1 contacts back surface 48 of pin portion 29-1 such that driving projection 11-1 moves to the position of driving projection 11-n by rotating pin wheel 28 in the direction indicated by arrow B. In this case, at first, end 53-1 of contacting portion 46 of damper 41 contacts tip 52 of reed 36 with pressure. Then, during rotation of pin wheel 28, tip 52 is released from pressure of contacting portion 46 such that pin portion 29-1 moves to the position of pin portion 29-8. During this operation, pin portion 29-1 picks tip 52 to vibrate reed 35. Also, 54 in the figure is a tuning weight formed on each reed 35.

Furthermore, in the case where there is driving projection 11-2 adjacent to driving projection 11-1 corresponding to the same reed 35 following pin portion 29-2 which may pick reed 35 even though reed 35 is vibrating within a damping period, before following pin portion 29-2 picks reed 35, end 53-2 of the following damper contacting portion contacts tip 52 of reed 35 such that vibration of tip 52 is reduced. As a result, pin portion 29-2 picks tip 52 which is almost still; therefore, broken sound due to clashing of tip 52 and pin portion 29-2 can be prevented. In other words, space "g" is formed between back surface 51 of arm portion 45 and front surface 50 of pin portion 29, and the material of damper 41 has appropriate viscoelasticity. Therefore, thin and flexible arm portion 45 bends when contacting tip 52 such that the impact of vibration can be reduced.

Arm portion 45 has a flexible shape extending with a relatively large curvature. Therefore, vibration remaining in reed 35 is sufficiently absorbed such that pin portion 29 always contacts still reed tip 52. As described above, when reed 35 and pin portion 29 contact each other, remaining vibration is prevented from causing noise due to the shape and the material of arm portion 45. At the same time, vibration of arm portion 45, which occurs at the moment when contacting portion 46 moves away from reed 35, can be rapidly reduced such that arm portion 45 itself does not cause noise.

Additionally, step portion 49 (such as a constraining portion) formed at arm portion 45 contacts back surface 48 of the preceding pin portion. Also, thick contacting portion 46 is directly supported between pin portions 29 of adjacent pin wheels. Therefore, even when an unexpected outside force is applied in the rotational direction to the curving portion and base portion of arm portion having a structure with high flexibility in the radial direction, function failure due to outward distortion of arm portion 45 does not occur.

As explained above, according to the music box of the present invention, the pin wheel and the damper are rotated together such that a torque loss due to the pressure, which the pin wheel receives by contacting the fixed damper member, can be reduced. Also, by using a motor for driving, consumed electricity can be reduced such that the battery life can be improved. Furthermore, in the case of using a spring for driving, duration of time to play music to a given stored energy can be extended.

Furthermore, the damper and the pin wheel can be matched to form a pair such that it is easier to obtain precision in the relative position of the damper to the pin wheel and the reed. Therefore, adjustment in assembly of the damper is not required such that efficiency in operation is improved. Also, precision in reducing vibration becomes uniform such that stable qualities can be provided.

Moreover, the damper is formed in a shape of a thin curving arm made of an elastic material such that vibration of the tip can be sufficiently absorbed. Also, a space was formed between the arm portion of the damper and the pin portion such that remaining vibration, which occurs when the tip and the preceding pin portion contact each other, can be reduced before the following pin portion picks the tip; as a result, noise, such as broken sound, caused by a contact between the tip and the following pin portion can be prevented. Furthermore, the step portion is formed in the arm portion to contact the pin portion; thus, distortion of the damper due to an outside force in the reverse direction can be prevented such that operation failure of the music box can be prevented.

Additionally, there is no need to fix the damper to the reed, therefore, precision in scales can be improved; also, tuning can be easily performed. Furthermore, a tuning procedure, in which scales are established higher by anticipating lowering in the scales due to adhering of the damper, can be omitted.

While the foregoing description and drawings represent the preferred embodiments of the present invention, it will be obvious to those skilled in the art that various changes and modifications may be made therein without departing from the true spirit and scope of the present invention.

What is claimed is:

1. A music box comprising:

a base disc which has a plurality of projections corresponding to a music piece on its surface;

a plurality of pin wheels which are individually rotated by contacting one of a plurality of said projections while said disc moves;

a reed which generates sound by being picked by a pin portion projecting in the radial direction of said pin wheels;

a plurality of dampers which are formed corresponding to each of said pin wheels to reduce vibration of said reed; and a fixed shaft which rotatably supports individual pairs of said pin wheels and said corresponding dampers;

said dampers further comprising:

a base portion which has a combining means to rotate together with said corresponding pin wheels;

an arm portion which is extended from said base portion to the vicinity of said pin portion; and a contacting portion which is the end of said arm portion placed near said pin portion and which comprises a rotation path common with said pin portion such that said contacting portion contacts said reed for reducing vibration before said pin portion contacts said reed.

2. The music box described in claim 1 in which said arm portion comprises a constraining portion, which contacts a preceding adjacent pin portion such that said pin portion provides support against an outside force applied in the rotational direction.

3. The music box according to claim 2 wherein:

said contacting portion is formed such that said pin portion and a side surface have the same thickness to be on the same plane;

said constraining portion is a step portion which is formed between said arm portion and said base portion; and a section of said pin portion facing said contacting portion is formed to be a tapered shape having a constant space with said contacting portion in parallel.

4. The music box according to claim 2 in which said arm portion is formed to have a thin arm curving at a relatively large curvature to be 90° such that a section between said constraining portion and the end is a free end which is not constrained by said pin portion.

5. The music box according to claim 3 in which said arm portion is formed to have a thin arm curving at a relatively large curvature to be 90° such that a section between said constraining portion and the end is a free end which is not constrained by said pin portion.

* * * * *